US011613339B2

(12) United States Patent
Lewis

(10) Patent No.: US 11,613,339 B2
(45) Date of Patent: Mar. 28, 2023

(54) SYSTEM AND METHOD ENABLING A HOISTED BOAT TO USE ITS ON-BOARD AIR CONDITIONING (A/C) UNIT

(71) Applicant: Robert G. "Bo" Lewis, Columbus, GA (US)

(72) Inventor: Robert G. "Bo" Lewis, Columbus, GA (US)

( * ) Notice: Subject to any disclaimer, the term of this patent is extended or adjusted under 35 U.S.C. 154(b) by 199 days.

(21) Appl. No.: 16/998,156

(22) Filed: Aug. 20, 2020

(65) Prior Publication Data

US 2021/0053666 A1 Feb. 25, 2021

Related U.S. Application Data

(60) Provisional application No. 62/890,760, filed on Aug. 23, 2019.

(51) Int. Cl.

| | |
|---|---|
| ***B63J 2/00*** | (2006.01) |
| ***B63J 2/02*** | (2006.01) |
| ***B63J 2/04*** | (2006.01) |
| ***B63J 2/12*** | (2006.01) |
| ***F24F 13/30*** | (2006.01) |

(52) U.S. Cl.

CPC ..... *B63J 2/02* (2013.01); *F24F 13/30* (2013.01)

(58) Field of Classification Search

CPC ..... B63J 2/00; B63J 2/02; B63J 2/04; B63J 2/08; B63J 2/12; B63J 2002/005; B63J 2002/125; F01P 3/205; F01P 2011/065; B63H 21/383

USPC ..... 62/240; 114/211, 212, 183 R, 198

See application file for complete search history.

(56) References Cited

U.S. PATENT DOCUMENTS

| | | | | |
|---|---|---|---|---|
| 5,848,536 | A * | 12/1998 | Dodge | B63J 2/04 62/286 |
| 2002/0017108 | A1* | 2/2002 | Schooley | B63J 2/04 62/240 |
| 2016/0129983 | A1* | 5/2016 | Giampiccolo | F24F 1/06 165/206 |
| 2016/0169561 | A1* | 6/2016 | Giampiccolo | F25B 13/00 62/428 |
| 2018/0086427 | A1* | 3/2018 | Stimmel | F01P 3/205 |
| 2020/0398965 | A1* | 12/2020 | Clark | B63J 2/02 |

OTHER PUBLICATIONS

The Hull Truth Boating and Fishing Forum, "Air Conditioning when on boat lift. Has anything changed?", 2016 (Year: 2016).*

* cited by examiner

*Primary Examiner* — David J Teitelbaum
*Assistant Examiner* — Jason N Thompson
(74) *Attorney, Agent, or Firm* — John G. Posa; Belzer PC

(57) ABSTRACT

A system and method allows boats to operate air conditioners while positioned above the water level. A dock-mounted control unit has an inlet for lake or seawater, an inlet for fresh water, and an outlet to the raised boat. The fresh water is temporarily used to prime the system, after which the boat's A/C system can operate normally. After the system is primed, a valve on the control unit is used to close off the fresh water inlet, and the fresh water hose may be removed. A Y-valve (or two 1-way valves) provides two settings, one for ordinary, on-water operation, and the other for use in conjunction with the invention. The invention allows the boat's AC system to function as though it were in the water, allowing normal heat exchange with the body of water and thus, normal A/C while on a lift or hoist.

16 Claims, 11 Drawing Sheets

SYSTEM AND METHOD ENABLING A HOISTED BOAT TO USE ITS ON-BOARD AIR CONDITIONING (A/C) UNIT

REFERENCE TO RELATED APPLICATIONS

This application claims priority to and the benefit of U.S. Provisional Patent Application Ser. No. 62/890,760, filed Aug. 23, 2019, the entire content of which is incorporated herein by reference.

FIELD OF THE INVENTION

This invention relates generally to watercraft and, in particular, to a system and method that enables boat owners to operate cabin air conditioning when the boat is out of water on a hoist or lift.

BACKGROUND OF THE INVENTION

FIG. 1 shows the components associated with a typical marine air conditioner. Seawater is drawn in through a hull fitting, strained, and pumped into a heat exchanger in the A/C unit. The water from the A/C unit is discharged through an outlet above the water line.

Although the marine A/C unit of FIG. 1 will not operate when the boat is on a hoist or lift, there are times when a boat owner wants the A/C on when the boat is out of the water for comfort or repairs. It is not possible to simply run a hose from the boat into the water because marine A/C pumps are not designed to lift the column of water in the hose from the water below into the boat. The higher the boat is off the water, the greater the strain on the pump, which may cause the pump to repeatedly trip or overheat.

There have been attempts to solve this problem, but all known solutions use an auxiliary pump on the dock by the lift to bring the seawater up to the boat. This is not only an expensive solution, pumps require electricity to operate as well as a weatherproof housing to protect the pump from the elements. While it is also possible to connect the boat A/C system to a pressurized fresh water hose on the dock, this water is typically made available for temporary use and may also require a fee.

The need remains, therefore, for an efficient, cost-effective system and method that enables boat owners to use their A/C units even when their boat is on a hoist or lift. Ideally, such a solution would not use any electricity or appreciable fresh water to operate.

SUMMARY OF THE INVENTION

This invention, called Poseidon AC, solves the problems outlined above by providing a system and method that allows boats equipped with air conditioning (A/C) to operate their air conditioners while on a boatlift above the water level. To accomplish this, the invention provides a dock-mounted control unit with an inlet for seawater, an inlet for fresh water, and an outlet to the raised boat. A small amount of fresh water is temporarily used to fill (i.e., prime) the pipe leading into the seawater, after which time the boat's A/C system can operate normally without having to lift the seawater in the pipe on its own. After the fresh water is used to flush the system, a valve on the control unit is used to close off the fresh water inlet, and the fresh water hose can be removed.

To facilitate interconnection to the control unit, a Y-valve is installed in the water line from the boat's through-hull inlet and A/C water pump, preferably before the boat's existing strainer. The Y valve has two settings, one for ordinary, on-water operation (BOAT A/C), and the other for use in conjunction with the invention (DOCK A/C). The invention allows the boat's AC system to function as though it were in the water, allowing normal heat exchange with the seawater and thus, normal air conditioning function while on a lift.

The invention provides boaters with the ability to enjoy an air-conditioned boat while out of the water. The boat cabin can be cooled, and therefore more tolerable for routine tasks and chores while inside the cabin of the boat while on a lift. Boat owners can spend more time on their boats and in the cabin for whatever objective they have. They can clean the cabin, perform maintenance in the cabin, spend the weekend on the boat or just hang out with family and/or friends.

The system and method can also help reduce bilge odors and/or mildew issues by allowing the marine A/C unit to do its job and control the climate inside the boat while on a lift while the owner are away. A further benefit allows boat owners to occasionally flush their AC strainers, pumps and AC system with freshwater, keeping the system healthier.

All of the above is possible while the boat is on the boat lift, without the user having to worry about the deleterious side effects that a boat may incur while being in the water for extended periods of time. The invention allows boat owners to appreciate the benefits of their lift while, at the same time, enjoying the benefits of air-conditioning.

DETAILED DESCRIPTION OF THE INVENTION

Figure 2:
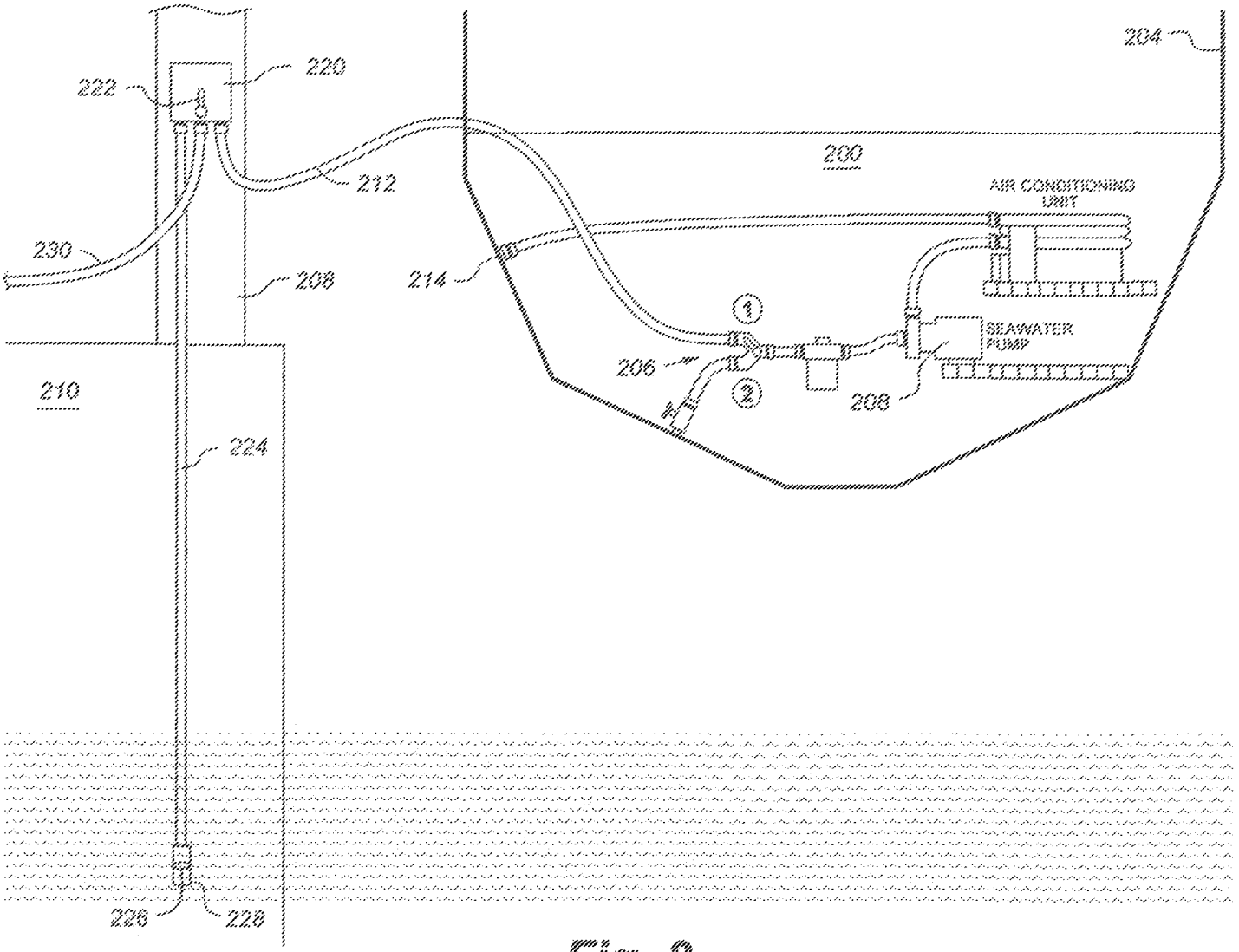
FIG. 2 is a diagram that illustrates interconnections according to the invention.

Continuing the reference to the accompanying drawings, FIG. 2 illustrates interconnections according to the invention that enables the A/C to run when the boat 200 is above the water line 202 on a hoist or lift 204. To facilitate operation, a valve 206 is installed in the line between the hull fitting and the pump 208. This valve may be installed on either side of an existing strainer depending upon the configuration of the boat's A/C unit, though preferably made on the inlet side of the strainer. While a pair of separate one-way valves may be used for this purpose, a single 2-way valve is more convenient. The valve has a first position (1) designated for "LIFT A/C," with the other position (2) being for "BOAT A/C."

A water line 212 is connected from the LIFT A/C side of the valve 206 to a control and distribution unit 220, which may be affixed to a post 208 or other structure on a dock 210, for example. Another conduit 224 connects to another fitting on the control unit 220. The distal end of conduit 224 is immersed in seawater, and preferably includes a one-way valve 226 and a filter 228. One-way valve 226 only permits the seawater to be drawn upwardly into the control unit 220. Note that in this and all embodiments disclosed herein, the term "seawater" should be taken to include any applicable body of water, as the invention may also be used for boats raised above fresh water lakes, rivers, etc.

The control unit 220 also includes a line 230 connected to a source of pressurized fresh water. It is anticipated that this line is a hose made available on marinas and docks, including private docks. In all embodiments of the invention, the control unit includes a valve 222 used to terminate the flow of pressurized fresh water into the control unit after the boat's A/C unit is adequately flushed and primed as described in further detail below. More robust embodiments include additional valves.

Figures 3A, 3B, 3C:
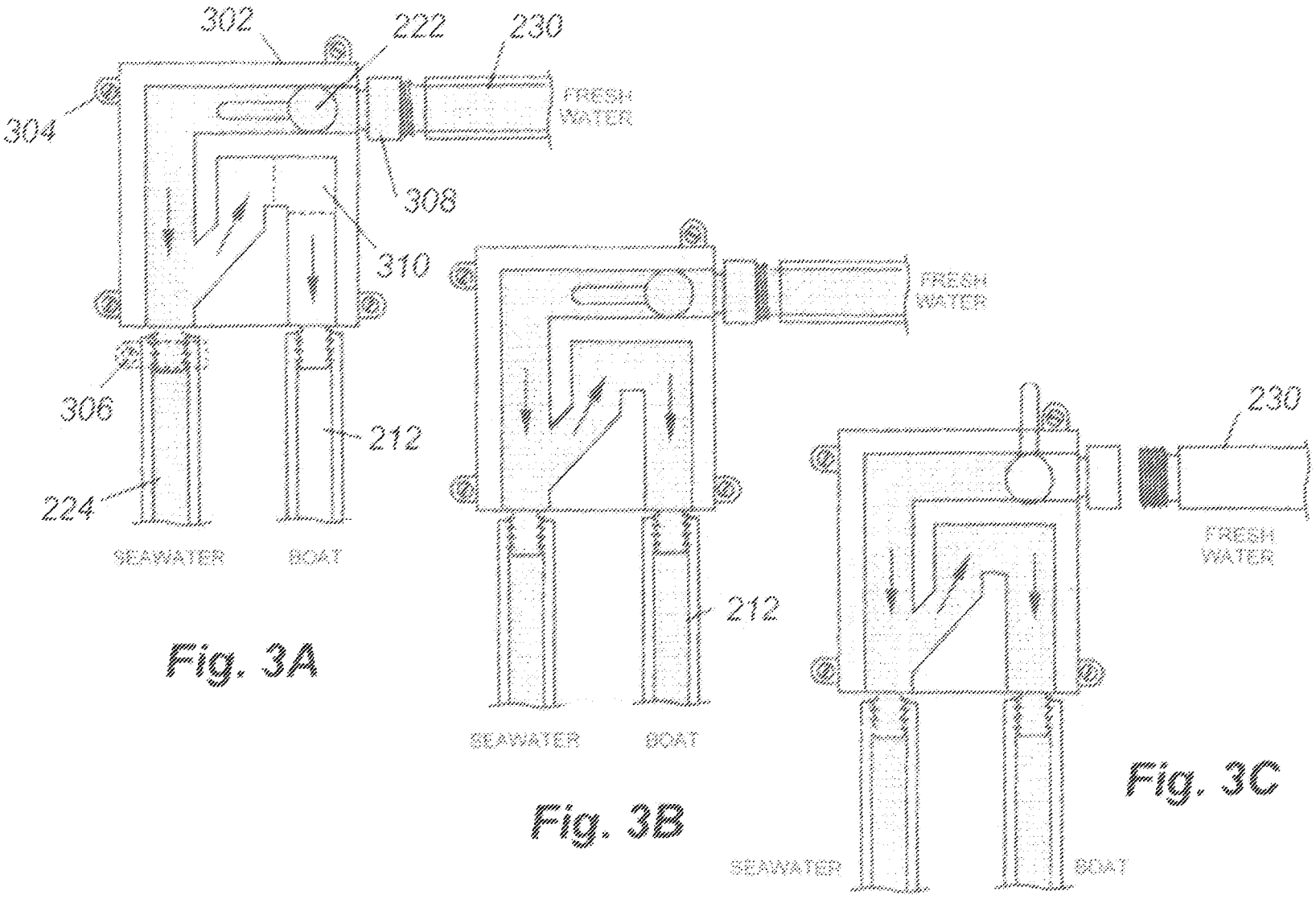
FIGS. 3A-C illustrate the operation of a basic embodiment of the invention without a separate purge line.

FIG. 3A-C illustrate the operation the control unit 220. The unit itself may utilize an enclosed housing with a cover (not shown) and tabs 304 or other features for mounting. The various fittings may be of any type, though airtight fittings are preferred for reliable operation. As such, most of the fittings may be barbed fittings with hose clamps 306, with the exception of the fresh water fitting 308 which typical uses a standard female garden hose fitting as provided on most docks.

The valve 222 is preferably 90-degree ball valve. The lines internal to the control unit may be any suitable material such as copper, brass, PEX, and so forth, and any elbows 310, tees, etc., may be soldered fittings or PEX connectors. Any valves may also be soldered or PEX-type components. The pressurized hose water first flows down in the seawater line 224, displacing any air in that line. When the seawater line becomes water-only, the pressurized hose water now flows into the boat's A/C unit through line 212, as shown in FIG. 3B.

Figure 1:
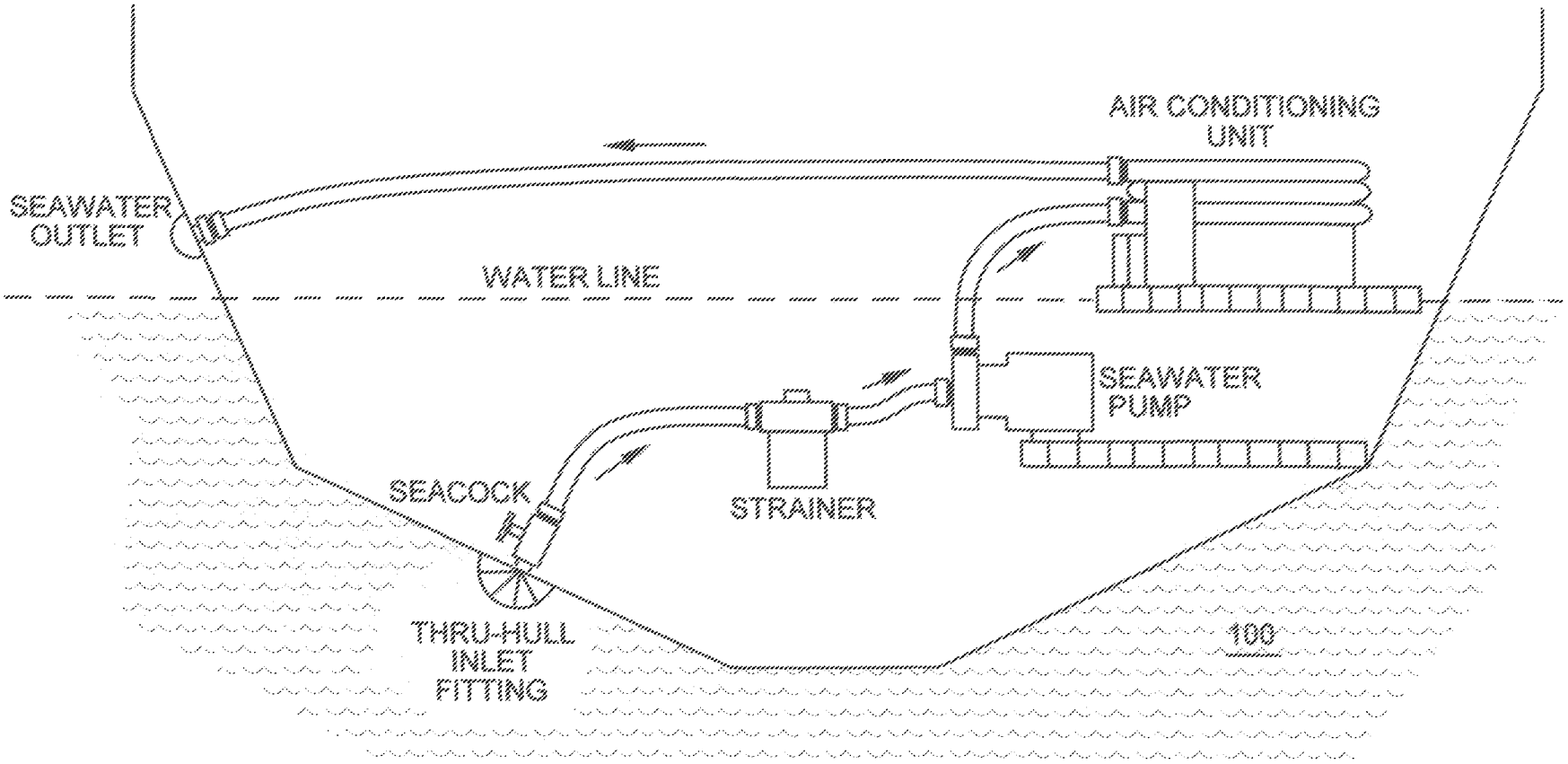
FIG. 1 is a simplified view of a marine air conditioning system.
Figure 3D:
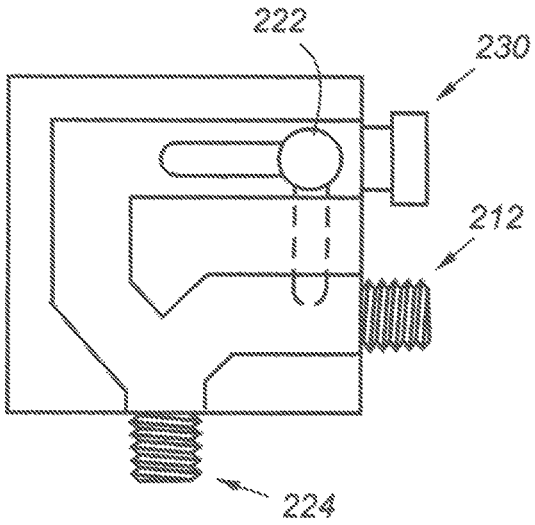
FIG. 3D is a drawing that shows how the plumbing within a housing may vary.
Figure 3E:
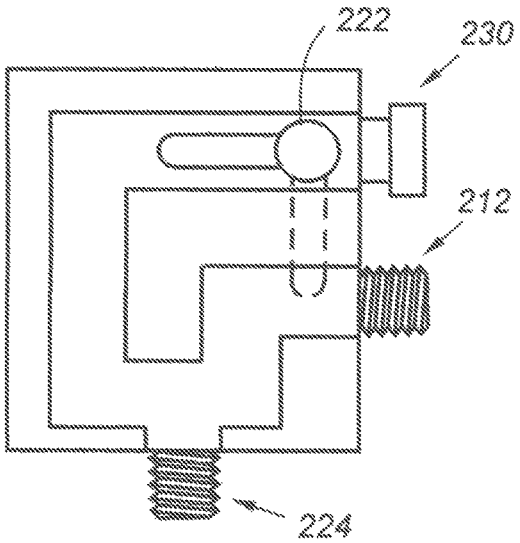
FIG. 3E is a drawing that shows a different configuration of the plumbing with a housing.

The user is made aware that the boat's A/C unit is fully flushed when the pressurized hose water flows uninterrupted out the boat's above-water outlet 214 shown in FIGS. 1, 2. At this point valve 222 may be turned OFF and the boat's A/C unit may be turned ON. The boat's A/C unit should now operate normally but if not, valve 222 may be opened temporarily to ensure that the entire network is devoid of any air pockets. At this point valve 222 may be left closed and, conveniently, hose 230 may be disconnected for others to use. FIGS. 3D, E show how the plumbing layout within a housing may vary.

Figure 3F:
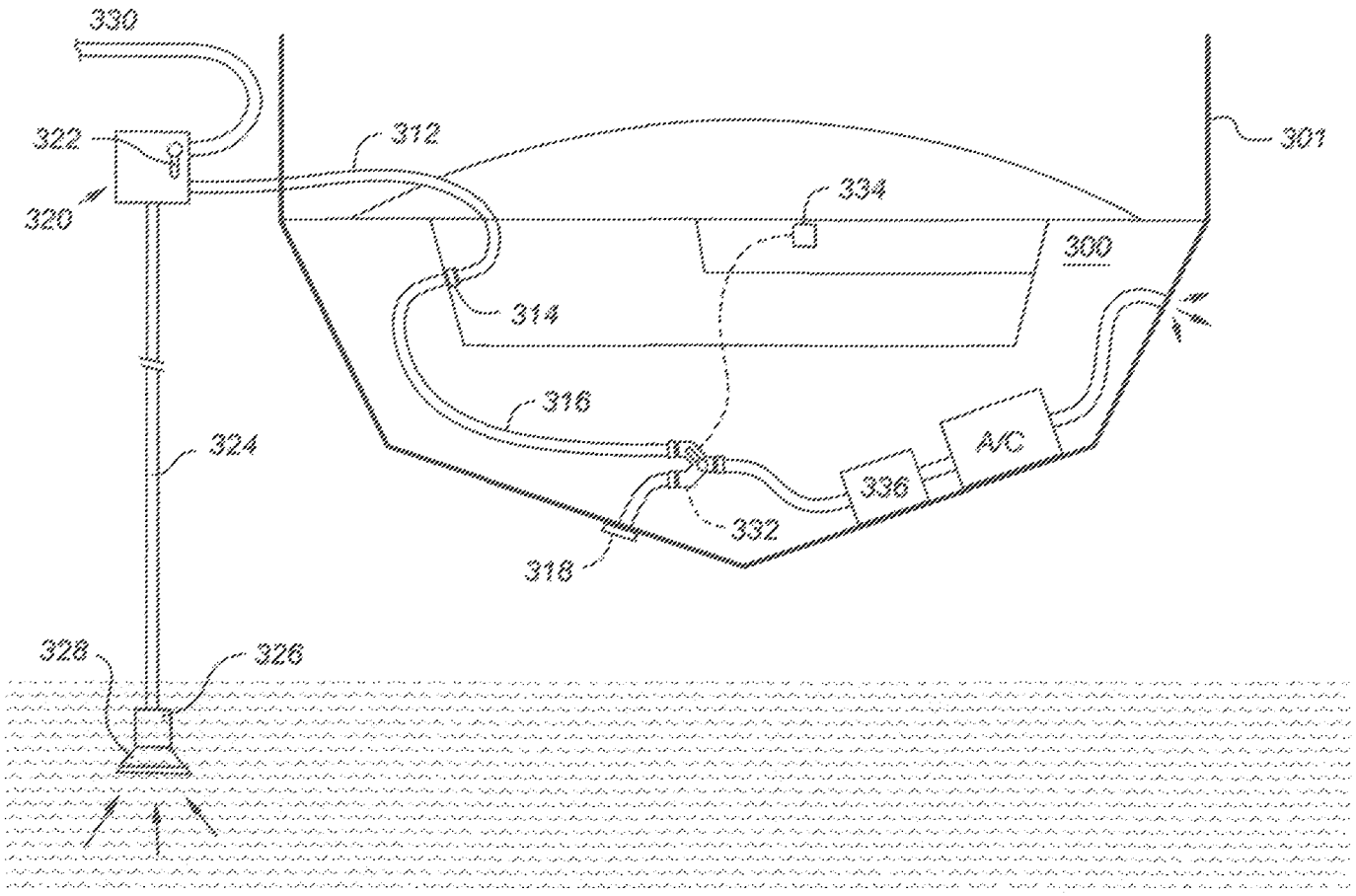
FIG. 3F shows a boat on a lift or hoist using an embodiment of the invention without a separate purge line.

FIG. 3F shows a boat 300 on a lift or hoist 301 using an embodiment of the invention without a separate purge line. The lines have been fully flushed with fresh water from line 330 and valve 322 has been closed, allowing water to be drawn up through strainer 328, check valve 326 and intake line 324. From there, the water passes through valve 332 and into the A/C unit through strainer 336. All embodiments may include a fitting 314 enabling hose 312 to connect to line without having to run line 312 below deck. Y-valve 332 may also be electrically operated in all embodiments, enable a user to switch the input from hull port 318 to line 316 remotely, for example, with a switch 334 in the cabin.

Figure 4:
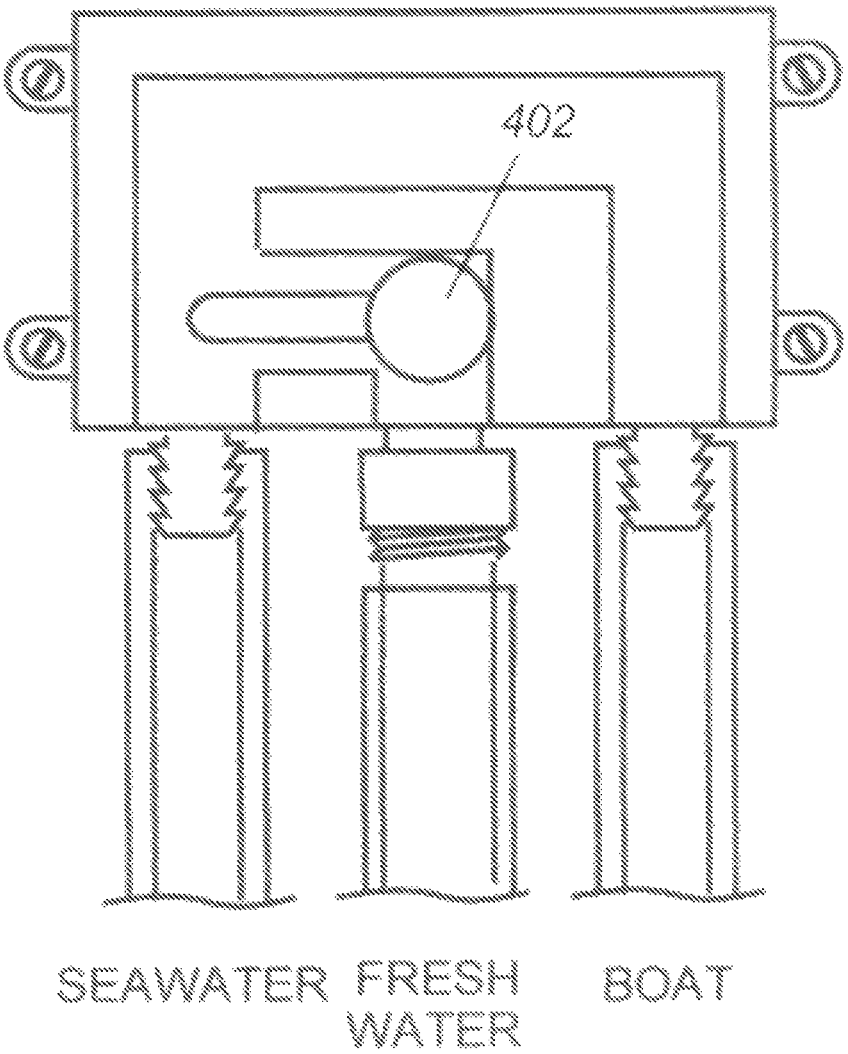
FIG. 4 depicts an alternative embodiment without a purge line.

FIG. 4 illustrates a different configuration but operation essentially remains the same. Valve 402 is opened, as shown, during the flushing and air-purging steps, then closed, enabling the pressurized fresh water hose to be detached.

Figure 5:
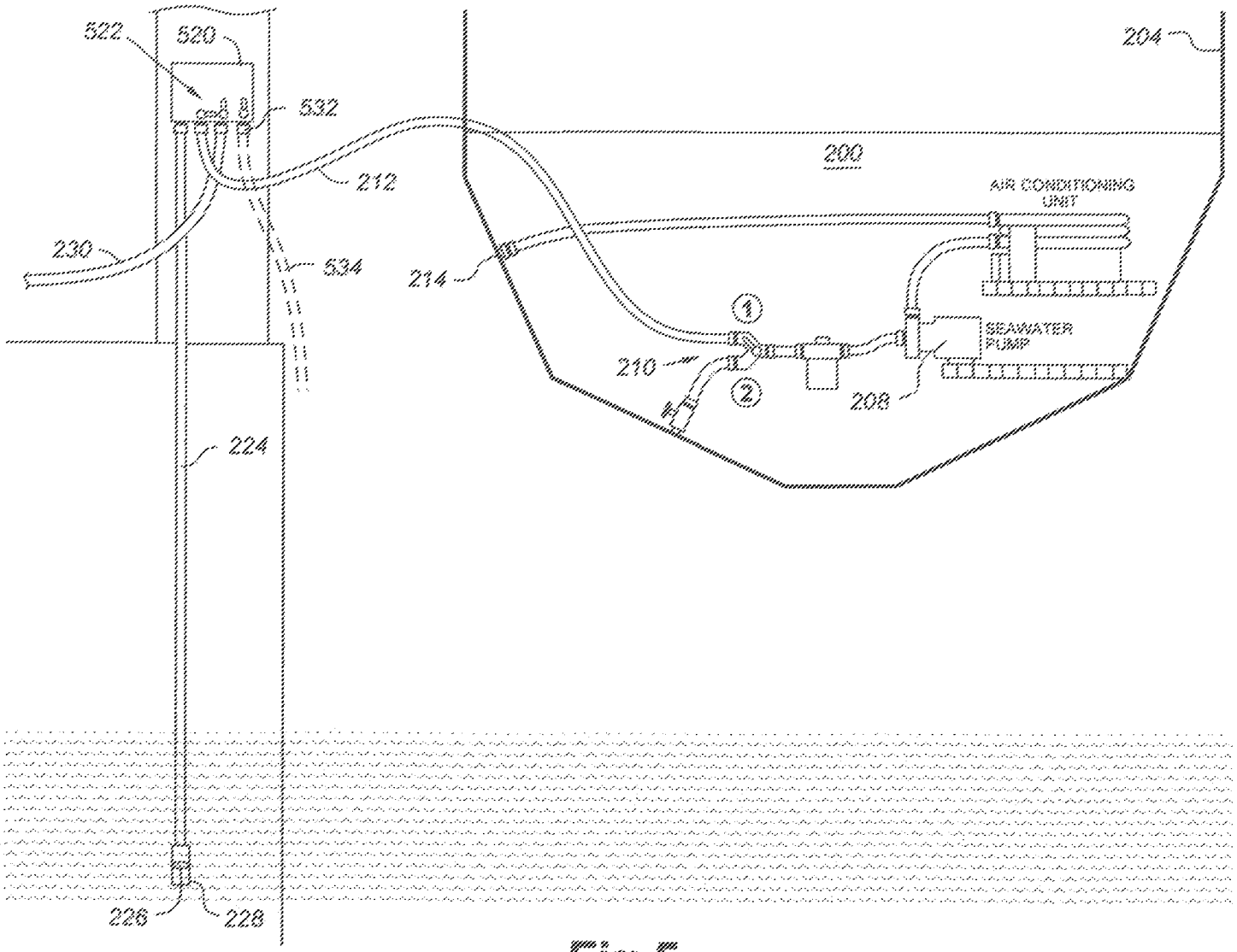
FIG. 5 is a diagram that illustrates interconnections according to an alternative embodiment of the invention that utilizes a separate purge line.

FIG. 5 is a diagram that illustrates interconnections according to an alternative embodiment of the invention that utilizes a control and distribution unit 520 with additional valves 522 and a separate purge port that may connect to an optional purge line 534. Again, connections are made to seawater through line 224; to the boat through line 212; and to pressurized fresh water through hose 230.

Figure 6A:
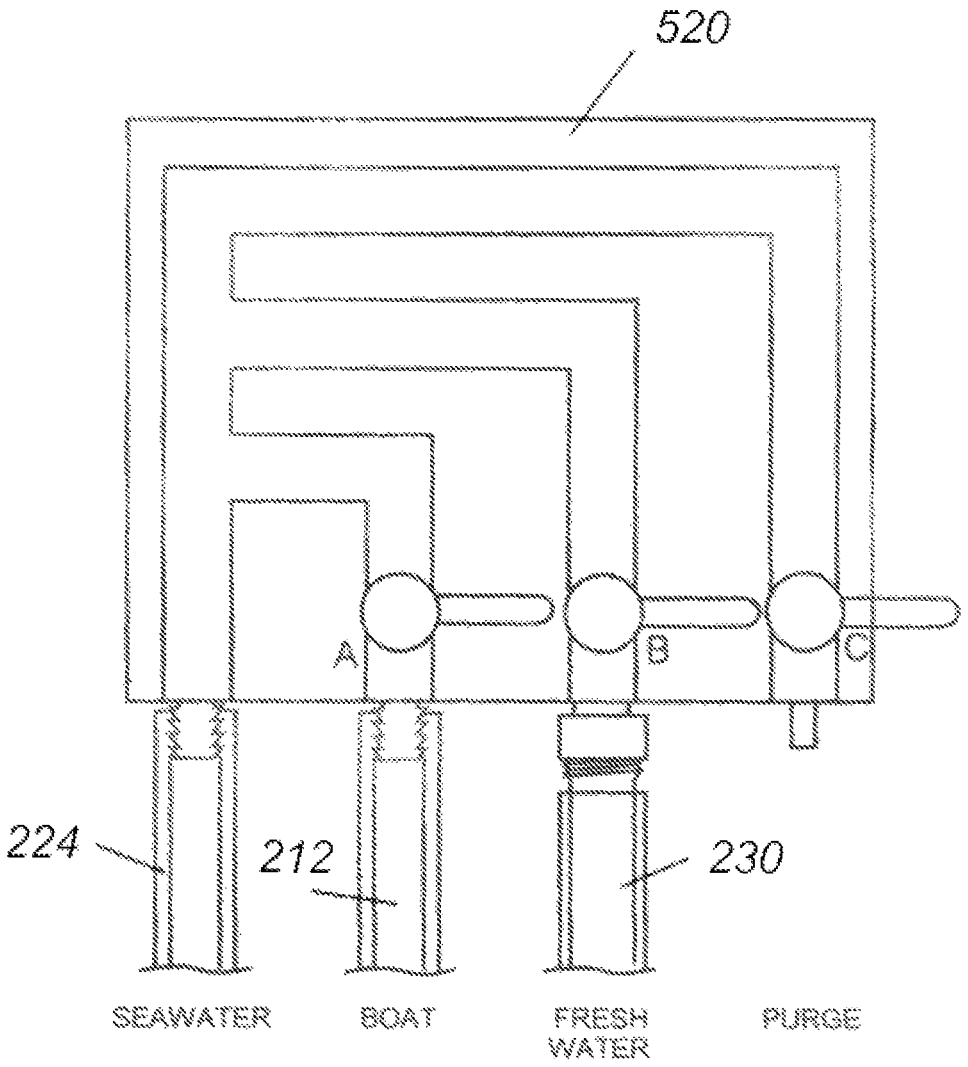
FIG. 6A illustrates the inside of a control and distribution unit associated with an alternative embodiment of the invention that utilizes a separate purge line.

FIG. 6A is a detail view illustrating the inside of control and distribution unit 522. The flow of pressurized water into the unit 522 is again controlled by a valve B, but additional valves A, C, are provided in support of the following functions. Seawater line 224 essentially into a manifold 600 from which the other lines extend, each with respective valves, A, B, C.

Figure 6B:
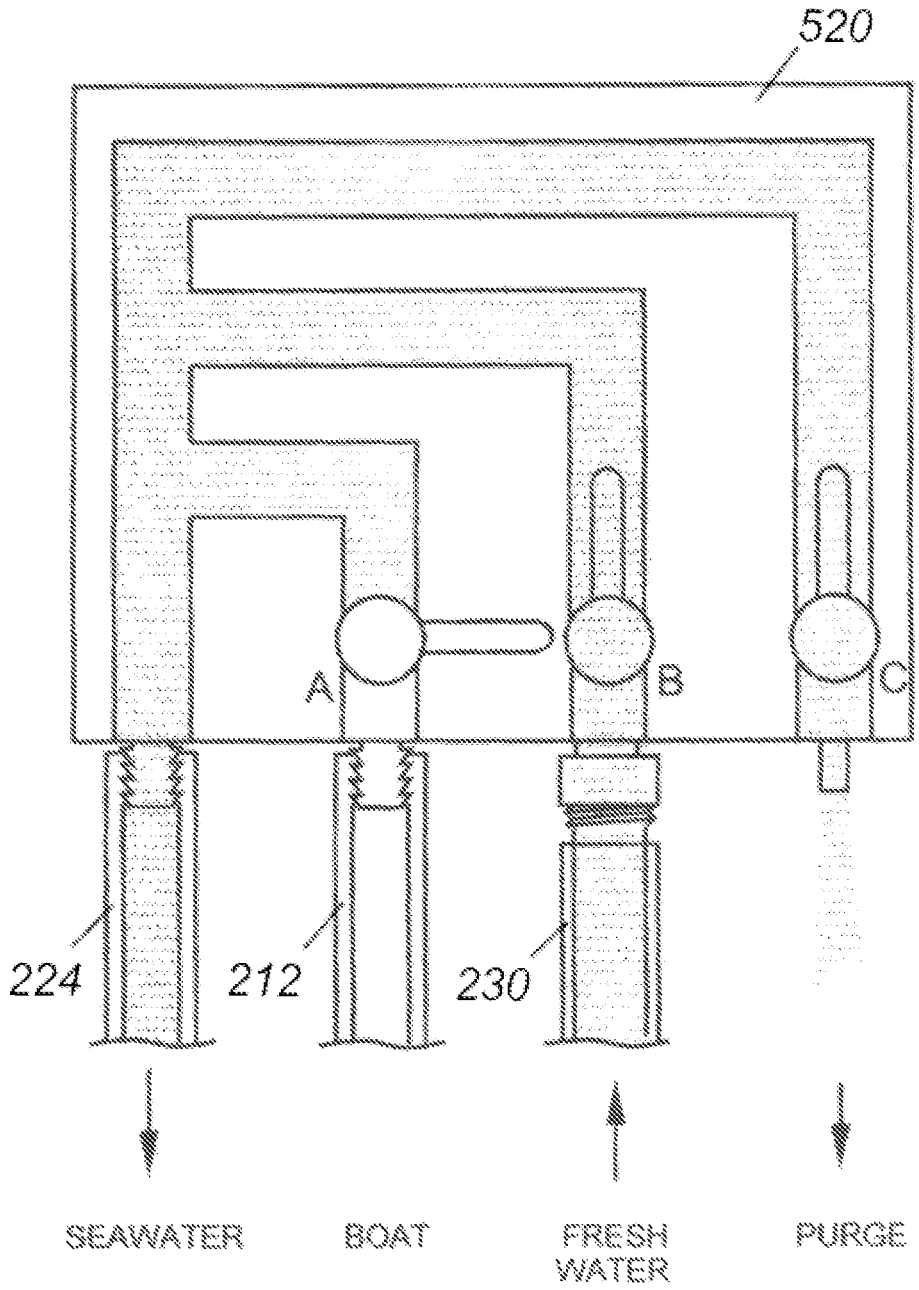
FIG. 6B illustrates the settings associated with priming the system of FIG. 6A to the seawater level.

FIG. 6B illustrates the settings associated with priming the system to the seawater level. With the 2-way valve in the boat set to DOCK A/C, and with the boat's A/C system OFF, the fresh water and purge lines are opened with valves B, C respectively. This allows fresh water to displace all of the air in the network, which escapes though the purge port. The incoming fresh water flows to the one-way valve at the distal end of the seawater line, displacing any air in that line, which escapes out the purge port.

Figure 6C:
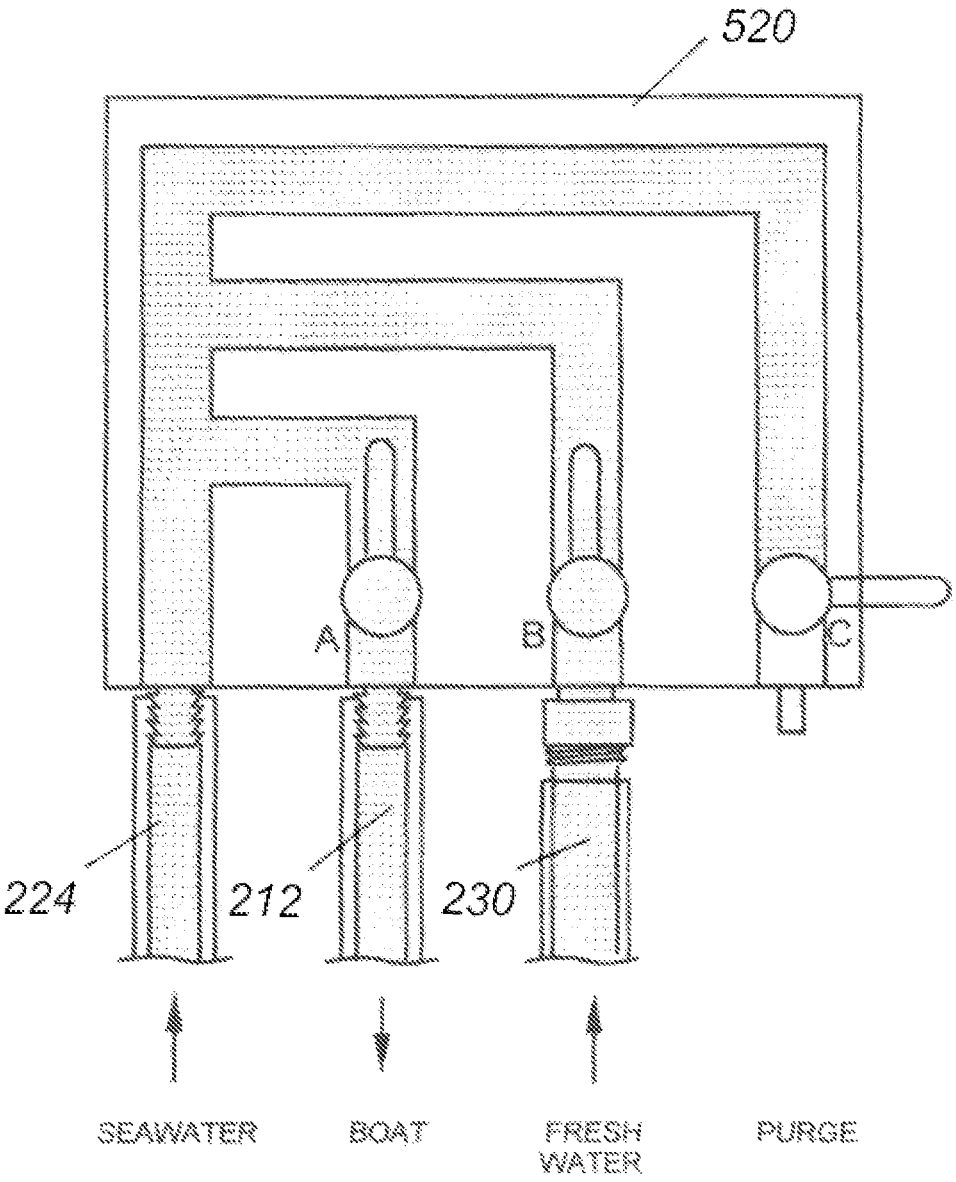
FIG. 6C illustrates the settings associated with priming the system of FIG. 6A to the boat.
Figure 6D:
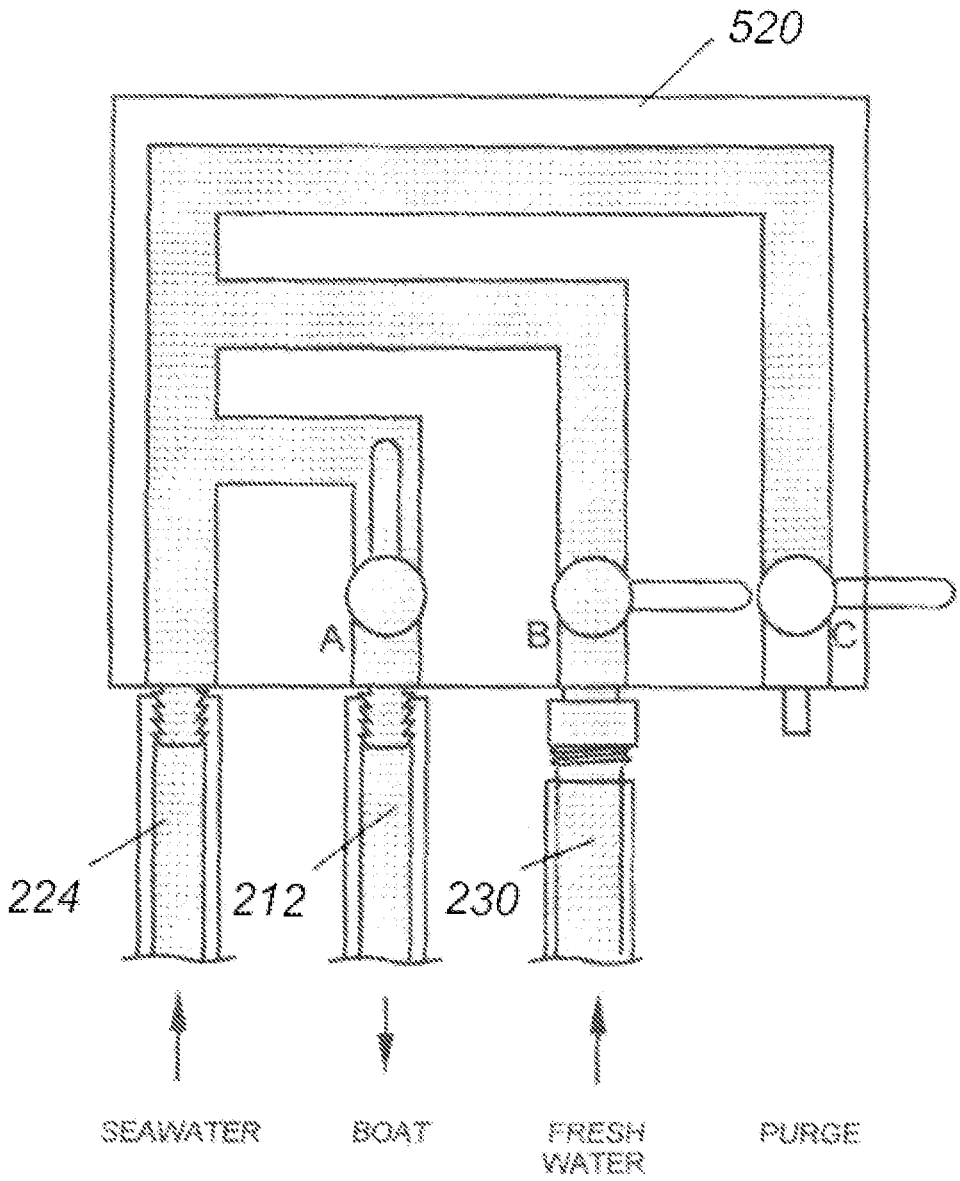
FIG. 6D illustrates final settings of the system of FIG. 6A in conjunction with a run condition.

The seawater line 224 is soon filled entirely with freshwater. At this point, valve A to the boat may be opened, and the purge valve C may be closed, as shown in FIG. 6C. When a steady stream of fresh water flows through the boat's A/C system and out the seawater outlet 214, the user knows the entire system has been primed with water, and the boat's A/C pump should have no difficulty drawing water up through the seawater line 224. At this point the boat's A/C system may be turned ON, and the fresh water valve B may be turned OFF, as shown in FIG. 6D.

In the event the boat's A/C pump is 'struggling,' valve B may be opened to allow additional fresh water purging. When the system is operating properly, valve B may again be closed. The fresh water hose 230 may again be detached for other users or uses.

The invention claimed is:

1. A system that enables a boat's air conditioning (A/C) unit having a water inlet to function with the boat raised above a body of water, comprising:

a water control and distribution unit configured for mounting above a body of water and proximate to a boat raised above the body of water;

wherein the control and distribution unit includes a first inlet for receiving water from the body of water, a second inlet adapted for connection to a source of pressurized water, and an outlet adapted for connection to the water inlet of the boat's A/C unit through a water line; and one or more valves on the control and distribution unit facilitating the following water-flow configurations:

a first configuration, wherein pressurized water flows from the second inlet to the water inlet of the boat's A/C unit through the outlet to flush and purge the water line, and a second configuration, wherein water flows from the body of water through the first inlet to the water inlet of the boat's A/C unit through the outlet and the water line, thereby enabling the boat's A/C unit to pump water directly from the body of water through the control and distribution unit.

2. The system of claim 1, further including one or more valves in the water line facilitating a first configuration, BOAT A/C, wherein the boat's A/C unit pumps water directly from the body of water through a hull port with the boat in the water, and a second configuration, DOCK A/C, wherein the boat's A/C unit pumps water from the body of water through the control and distribution unit.

3. The system of claim 2, wherein the one or more valves in the water line are located on-board the boat.

4. The system of claim 2, wherein the one or more valves in the water line are remotely controlled.

5. The system of claim 1, wherein the second inlet for receiving pressurized water comprises a garden hose connection.

6. The system of claim 1, wherein:

the first and second inlets and the outlet are all in communication with a manifold internal to the control and distribution unit; and wherein the manifold further includes a valve-controlled purge port operative to purge the manifold and the first inlet for receiving water from the body of water.

7. The system of claim 1, including a single two-way valve having a first position wherein only the first inlet is connected to the outlet and a second position wherein only the second inlet is connected to the outlet.

8. The system of claim 1, including a vertically oriented water pipe having a lower end emersed in the body of water and an upper end connected to the first inlet of the water control and distribution unit.

9. The system of claim 8, wherein the pipe vertically oriented water includes a one-way check valve such that water only flows from the body of water to the control and distribution unit.

10. The system of claim 1, including a single two-way valve in the water line to the boat switchable between BOAT A/C, and dock DOCK A/C.

11. The system of claim 10, wherein the single two-way valve is located on-board the boat.

12. A method of enabling a boat's air conditioning (A/C) unit to function with the boat raised above a body of water, comprising the steps of:

providing a water control and distribution unit having an internal water manifold in communication with first and second valved water inlets and a water outlet;

connecting the first inlet to a body of water beneath the raised boat;

connecting the second inlet to a source of pressurized water;

connecting the outlet to the boat's air conditioning A/C unit;

controlling the valved water inlets to:

(a) purge the connection to the boat's air conditioning A/C unit with the pressurized water, then:

(b) switch the connection to the boat's air conditioning A/C unit from the pressurized water to the body of water beneath the raised boat.

13. The method of claim 12, further including the step of installing valving in the connection to the boat's A/C unit, and wherein the valving has a first position, BOAT A/C, wherein the boat's A/C unit functions normally with the boat in the water, and a second position, DOCK A/C, wherein the boat's A/C unit pumps water through the connection to the body of water.

14. The method of claim 12, wherein the valving is remotely controlled.

15. The method of claim 12, wherein the pressurized water is fresh water from a garden hose connection.

16. The method of claim 12, further including the step of purging at least the manifold.

* * * * *